US011104485B2

(12) United States Patent
Mulford et al.

(10) Patent No.: US 11,104,485 B2
(45) Date of Patent: Aug. 31, 2021

(54) PATCH VENT FOR FLEXIBLE PACKAGING BAGS

(71) Applicant: Emmerson Packaging, Amherst (CA)

(72) Inventors: Emlyn Mulford, Amherst (CA); Alan P. Dewberry, Amherst (CA)

(73) Assignee: EPC Industries Limited, Amherst (CA)

( * ) Notice: Subject to any disclaimer, the term of this patent is extended or adjusted under 35 U.S.C. 154(b) by 0 days.

(21) Appl. No.: 16/169,657

(22) Filed: Oct. 24, 2018

(65) Prior Publication Data

US 2019/0193896 A1 Jun. 27, 2019

Related U.S. Application Data

(60) Provisional application No. 62/576,353, filed on Oct. 24, 2017.

(51) Int. Cl.
*B65D 33/01* (2006.01)
*B65D 77/22* (2006.01)

(52) U.S. Cl.
CPC ..... *B65D 33/01* (2013.01); *B65D 77/225* (2013.01); *B65D 2205/025* (2013.01)

(58) Field of Classification Search
CPC . B65D 33/01; B65D 77/225; B65D 2205/025
USPC ..... 383/100–103
See application file for complete search history.

(56) References Cited

U.S. PATENT DOCUMENTS 3,468,471 A * 9/1969 Linder ..... A61B 50/30 206/439
3,503,497 A * 3/1970 Adiletta ..... A61B 50/30 206/365
3,575,170 A * 4/1971 Clark ..... A61F 5/44 96/6
3,998,255 A * 12/1976 Mather ..... A61F 5/441 383/102
4,134,535 A * 1/1979 Barthels ..... B65D 77/225 137/251.1
4,600,420 A * 7/1986 Wydeven ..... B01D 46/10 264/136

(Continued)

FOREIGN PATENT DOCUMENTS

JP 05124656 A * 5/1993

OTHER PUBLICATIONS

Donaldson Company, Inc.; Press-Fit enclosure protection vents; https://www.donaldson.com/content/dam/donaldson/venting/literature/north-america/press-fit/f118507-eng/Press-Fit-Enclosure-Protection-Vents.pdf.

*Primary Examiner* — Jes F Pascua
(74) *Attorney, Agent, or Firm* — Garvey, Smith & Nehrbass, Patent Attorneys, L.L.C.; Seth M. Nehrbass; Fabian M. Nehrbass

(57) ABSTRACT

A method of manufacture and an adhesive patch vent is provided for application to a flexible packaging material. A fabric material has an adhesive applied to its surface. The adhesive being applied to outer portions of the fabric material where a central portion is adhesive free. The adhesive patch vent is applied to an interior of a flexible package material where the adhesive free portion aligns with a perforation in the flexible package material. The adhesive vent patch enables air to be expelled from a package but is resistant to damage to the exterior of the bag. In addition a food grade oil resistant adhesive is utilized.

9 Claims, 7 Drawing Sheets

(56) References Cited

U.S. PATENT DOCUMENTS

| | | | | | |
|---|---|---|---|---|---|
| 5,171,439 | A * | 12/1992 | Vakharia | B01D 19/0031 | 210/436 |
| 6,070,728 | A * | 6/2000 | Overby | B65D 77/225 | 137/526 |
| 6,120,817 | A * | 9/2000 | Archibald | B65D 33/01 | 383/102 |
| 6,358,731 | B1 * | 3/2002 | Hsu | C12M 23/14 | 435/297.1 |
| 7,243,683 | B2 * | 7/2007 | Stotkiewitz | B65D 77/225 | 137/512.15 |
| 7,244,223 | B2 | 7/2007 | Hartman et al. | | |
| 7,399,263 | B2 | 7/2008 | Hartman et al. | | |
| 7,772,139 | B2 * | 8/2010 | Chandra | B65D 33/01 | 442/72 |
| 9,427,710 | B2 * | 8/2016 | Jansen | B01D 71/26 | |
| 2004/0238397 | A1 * | 12/2004 | Yu | B65D 33/01 | 206/524.8 |

* cited by examiner

PATCH VENT FOR FLEXIBLE PACKAGING BAGS

CROSS-REFERENCE TO RELATED APPLICATIONS

This application is a non-provisional application of U.S. Provisional Application No. 62/576,353 filed Oct. 24, 2017 the entirety hereby incorporated by reference in its entirety for all purposes.

TECHNICAL FIELD

The present disclosure relates venting for air evacuation in flexible packaging bags and in particular to patch vents.

BACKGROUND

Flexible packaging typically requires air evacuation for boxing or palletizing bags. For some food products, such as for example pet food, insect infestation, particle contamination, or oil migration to outside surfaces can be a concern.

Common air evacuation methods use small slits or perforations in the package walls but are susceptible to infestation, contamination or oil migration depending on the environment and food types. In some cases an adhesive patch is applied over the openings of the package to provide a controlled or filtered venting system. However, existing patches that are available in the market that go on the outside, or exterior, of the bags pose problems when they do not provide adequate air flow, cover graphic design areas, are susceptible to being scraped off or damaged during shipping and handling or are too large to fit in optimal locations on the package.

Accordingly, an improved patch vent and method of venting flexible packages remains highly desirable.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

In accordance with an aspect of the present disclosure there is provided an adhesive patch vent for application to a flexible packaging material, the patch vent comprising: a fabric material; and an adhesive applied to a surface of the fabric material, the adhesive being applied to outer portions of the fabric material where a central portion is adhesive free; wherein the adhesive patch vent is applied to an interior of the flexible package material where the adhesive free portion aligns with a perforation in the flexible package material.

In accordance with another aspect of the present disclosure there is provided a method of manufacturing a flexible package with an adhesive patch vent, the method comprising: receiving a rollstock material; perforating the rollstock material to form a vent opening; applying the adhesive patch vent to a side of the roll stock over the perforation in the rollstock material; forming a flexible package having the adhesive patch vent on the interior of the package.

In accordance with yet another aspect of the present disclosure there is provided a method of manufacturing an adhesive patch vent for application to a flexible packaging material, the method comprising: cutting a filtering fabric to fit the adhesive patch vent; cutting a cover out of a plastic material; cutting an opening within the cover to be aligned with a perforation in a packaging material; adhering the filtering fabric to the cover; and applying the filtering fabric to the cover.

Embodiments are described below, by way of example only, with reference to FIGS. 1-15.

Figure 1:
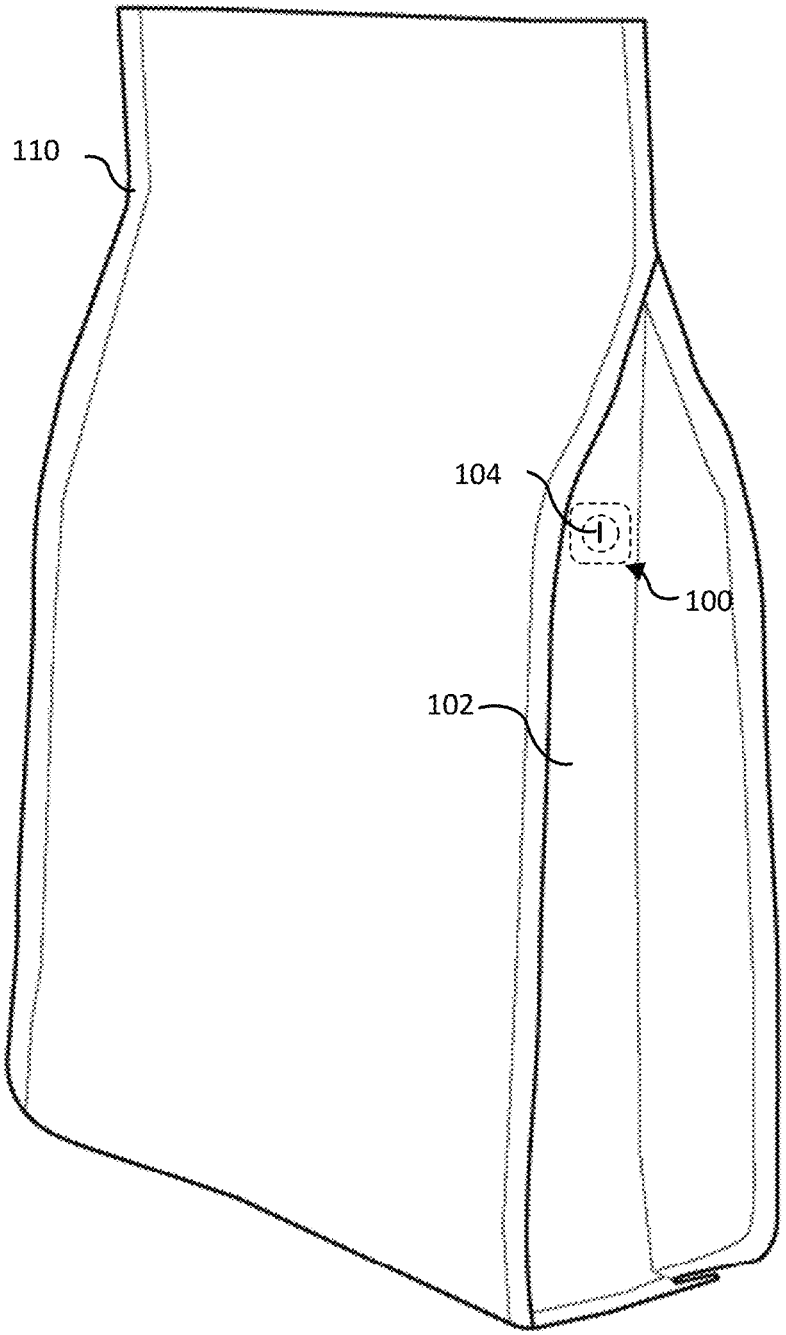
FIG. 1 shows a representation of a flexible package having an interior patch vent.

As shown in FIG. 1 a flexible package 110 having a patch vent 100 is shown. The patch vent is affixed on the interior of the package, in this example on a side gusset 102, to allow air to be removed while not allowing insects or particles to enter the package while also mitigating oil and grease migration to the outside walls of the package 110. A concealed filtered venting solution is disclosed by applying a small filtering patch 100 on the inside of the bag wall 110 covering a small opening 104 in the bag. The vent opening 104 in the package wall 102 can be approximately 0.25 inch in order to register with approximately 0.5 inch no adhesive air flow area on the patch 100. The fabric utilized provides opening less than approximately 80 microns for example specific to Indian Meal Moth infestation. Although dimensions are provided for the vent opening, patch and fabric, a person of ordinary skill in the art will understand that the dimensions may vary based upon the packaging, product and materials utilized. The vent match utilizes food-grade adhesive and compatible material to mitigate contamination or interaction with the food content of the bag while allowing venting. The patch vent is suitable for food applications such as for example large pet food bags, although they may be utilized for other food applications.

Figure 2:
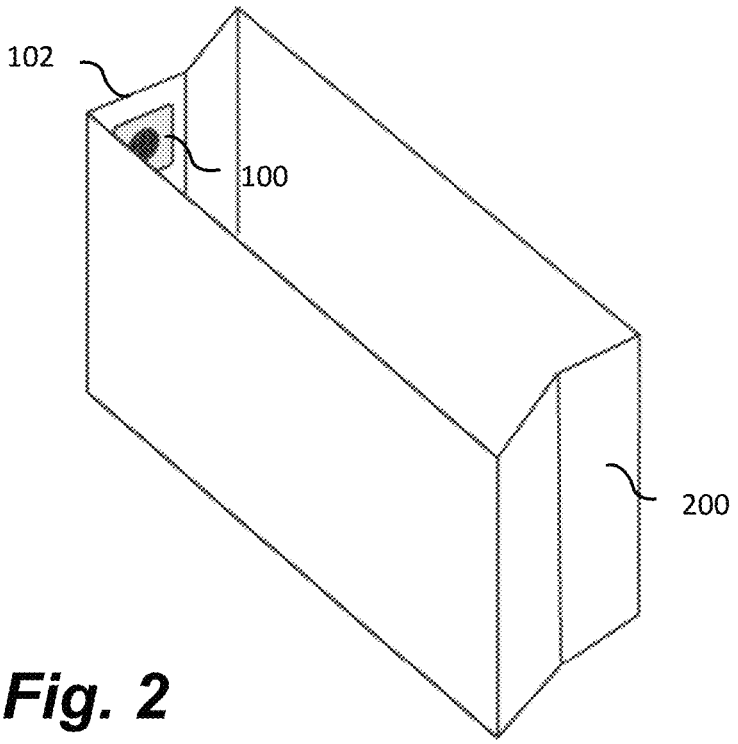
FIG. 2 shows a representation of an interior of a flexible package having an interior patch vent on a side gusset.
Figure 3:
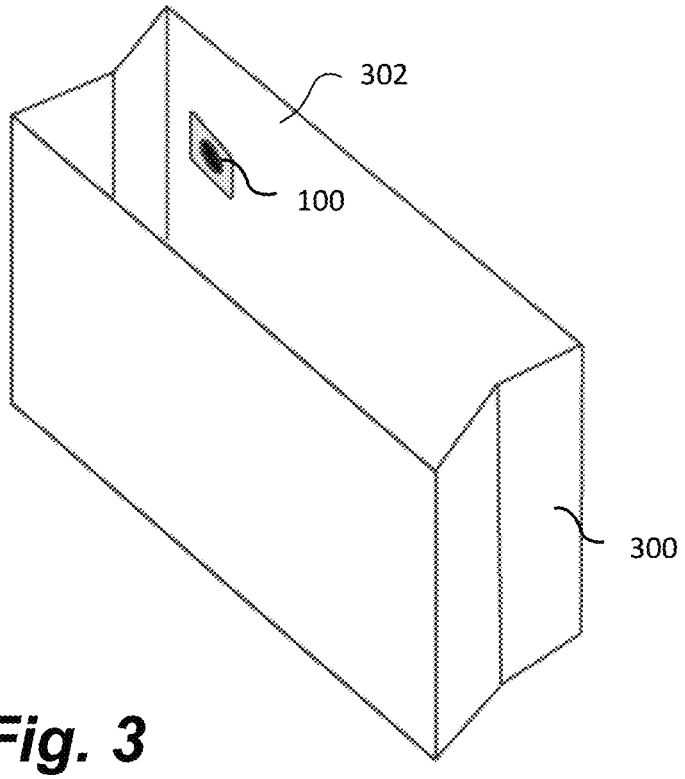
FIG. 3 shows a representation of an interior of a flexible package having an interior patch vent on a front or back package surface.

FIG. 2 shows an interior of a flexible package 200 having a patch vent 100 on a side gusset which may be adhered to the package by an adhesive or heat sealing. The patch 100 may be approximately 1 inch by 1 inch in an area with an opening of approximately 0.5 inch in diameter, alternatively a larger dimensions can be used such as 2 inch by 2 inch to provide a larger opening. A person of skill in the art will understand that other dimensions may be utilized. FIG. 3 shows an interior of a flexible package 300 where the patch vent is located on a front, back, or major surface 302 of the package (or bag) formed by flexible packaging material. It should be understood that the fabric patches can be applied in any location on the film web/inside of the bag. The preferred width is in order to fit in one leg of the gussets where the patch is between a side seal and center fold where a maximum of approximately 1 inch width is optimal for performance and material costs.

Figure 4:
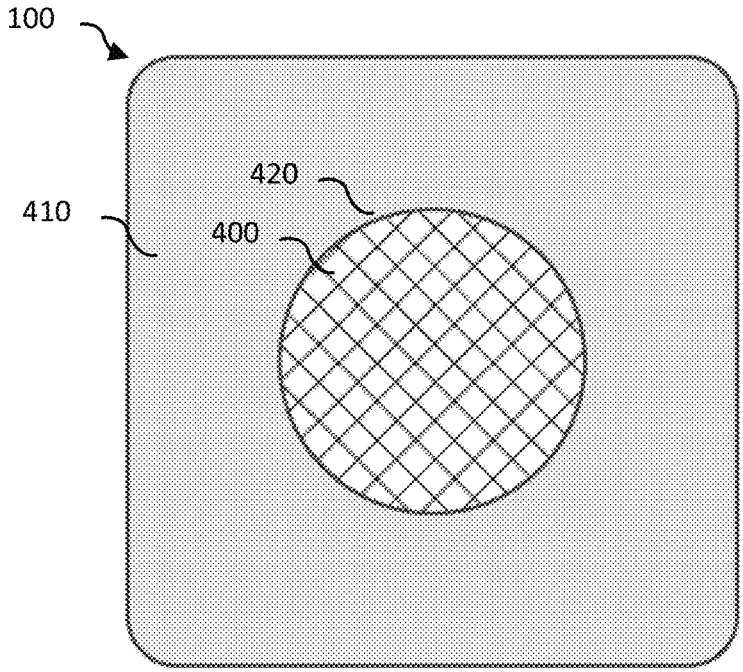
FIG. 4 shows a representation of a patch vent according to an embodiment of the present invention.

FIG. 4 shows a representation of a patch vent 100 having an opening 420 in a surface material 410. The opening 420 exposes a fabric 400 through an opening which allows air to pass from the interior of the package to the exterior. The surface material 410 comprise a plastic cover which secures the fabric by adhesive or by heat sealing to the interior of the package. The fabric layer 400 is designed to provide good air flow with good filtering characteristics for preventing insect infestation and contamination from foreign particles. Fabric 400 is also absorptive to prevent oils, fats and liquids from migrating to outside of package. The fabric layer material is also designed to be heat sealed to inside wall of bag in addition to adhesive seal if necessary. The adhesive utilized is food grade non oil soluble adhesive.

Figure 5:
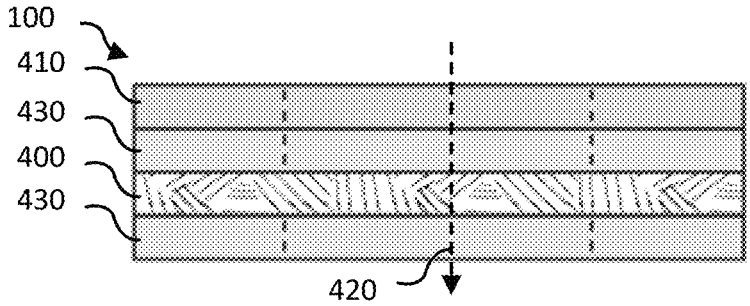
FIG. 5 shows a representation of a side view of a four layer adhesive patch vent.

Referring to FIG. 5, the patch vent 100 may comprise four layers. In this embodiment of the patch 100, the fabric 400 is sandwiched between adhesive layers 430 with a plastic cover 410 depending on package contents. The adhesive layer designed to withstand exposure to cold, heat, oils, fats, and liquids.

Figure 6:
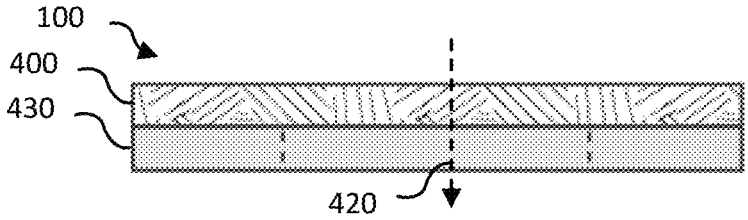
FIG. 6 shows a representation of a side view of a two layer patch vent.

FIG. 6 shows a representation of a side view of a two layer adhesive patch vent where a plastic cover is not required. The fabric 400 is attached to adhesive layer 430 having an opening 420. The fabric which can be utilized for heat sealing can be made from a polyethylene fiber that would melt into the flexible packaging material polyethylene bag wall. The covered configuration of FIG. 5 or the uncovered of FIG. 6 could be attached by heat seal to the bag wall.

The filtering fabric and cover materials can be made of various materials but not limited to polyethylene, polypropylene, polyester, nylon, cotton etc. and can be made of recyclable using recyclable materials to be consistent with the recyclable flexible package materials. For example a polyethylene package with a polyethylene fabric patch with same cover can be recyclable The patch vent can be manufactured with food safe materials and adhesives that stand up in hot and cold environments with oils and fats that can attack pressure sensitive adhesives. The patch vent will perform in extreme environments since it is inside package with the food and must not come off in package.

Figure 7:
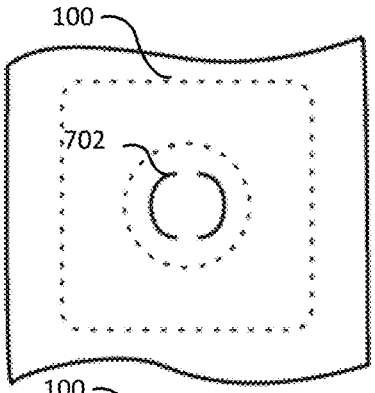
FIGS. 7-12 show examples of possible perforation patterns for the exterior surface of the flexible package.
Figure 10:
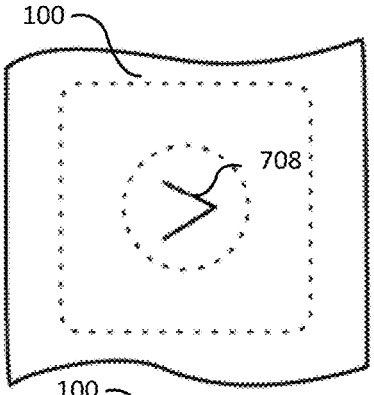
Figure 8:
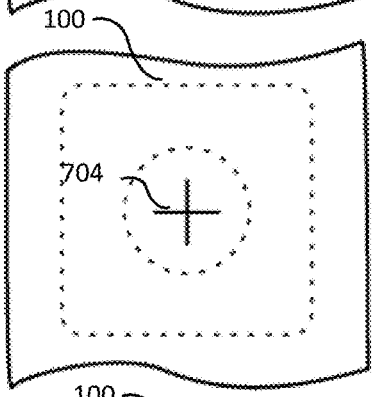
Figure 11:
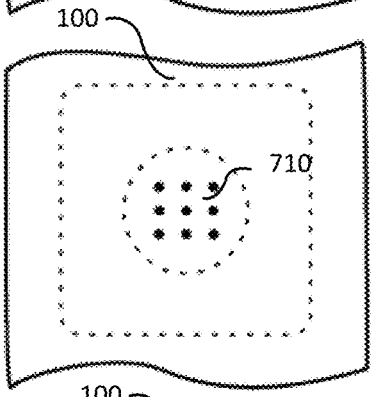
Figure 9:
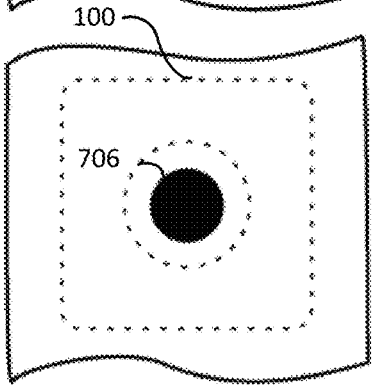
Figure 12:
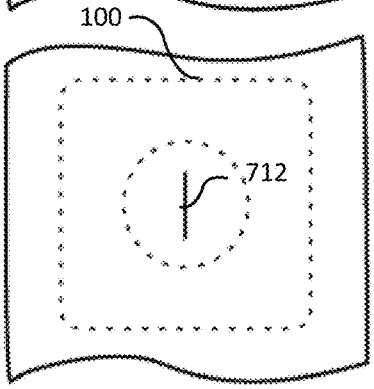

The fabric patches 100 cover a small opening in the interior of the bag. The openings can be formed in a variety of ways depending on air evacuation requirements. Openings in the bags can be formed in many shapes and configurations and include but not limited to slits, round holes, semicircular cuts, cross shaped cuts, v-shaped cuts, needle punches, laser perforations etc. FIGS. 7-12 show examples of perforation patterns for the exterior surface of the flexible package although other patterns can be utilized. The outer surface of the flexible package is perforated to allow air flow through the patch. As shown in FIG. 7, a butterfly perforation 702 formed in the surface of the package aligned with the fabric of patch 100. As shown in FIG. 8 a cross-slit perforation 704 formed in the surface of the package aligned with the fabric of patch 100. As shown in FIG. 9 a hole punch perforation 706 formed in the surface of the package aligned with the fabric of patch 100. As shown in FIG. 10 V-punch perforation 708 formed in the surface of the package aligned with the fabric of patch 100. As shown in FIG. 11 a needle punch perforation 710 formed in the surface of the package aligned with the fabric of patch. As shown in FIG. 12 an air slit perforation 712 formed in the surface of the package aligned with the fabric of patch 100. A person of ordinary skill in the art would understand that the perforation in the bag may encompass different shapes and configurations without departing from the scope of the present invention.

Figure 13:
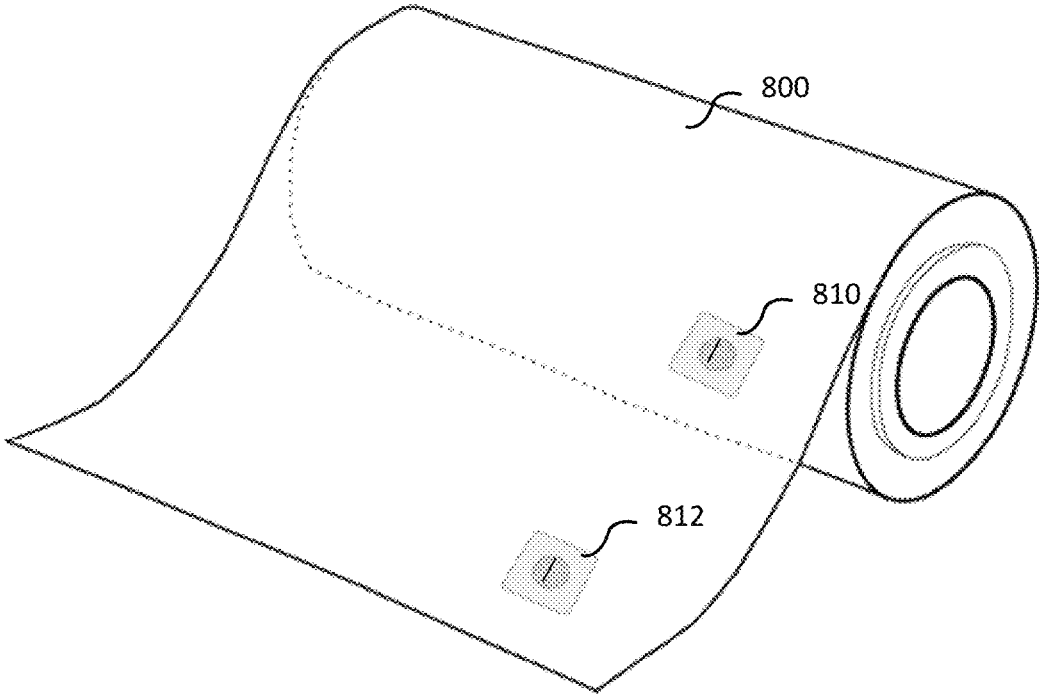
FIG. 13 shows a representation of roll-stock having patch vents applied thereon.

As shown in FIG. 13, the patches such as patch 810, and patch 812 can be pre-applied on a rollstock product 800 (sold in roll form) with perforations made on the exterior of the rollstock product 800. The customer forms, fills and seals the package created from the rollstock product 800 in their packing facility or patches can be applied inline on film web running on pre-made bag making machines.

Figure 14:
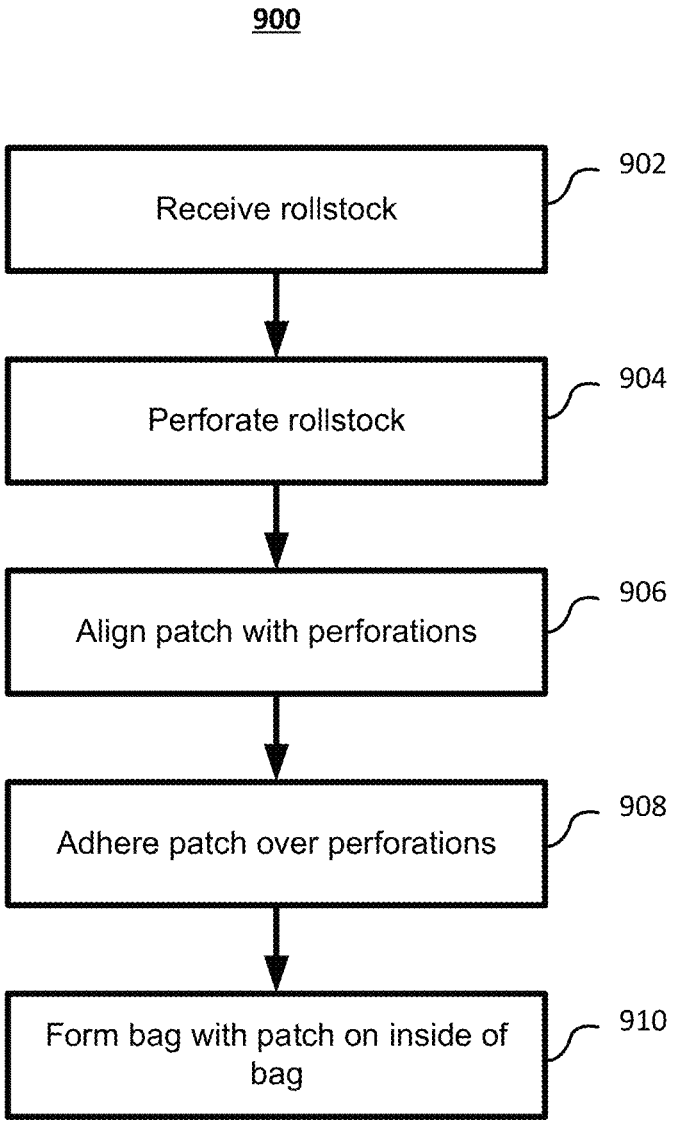
FIG. 14 shows a method of manufacturing a flexible package having a patch vent.

FIG. 14 shows a method 900 of manufacturing a flexible package having an adhesive patch vent. A rollstock material is received for forming the flexible package (902). The rollstock is perforated to provide an opening (904) through the surface of the material. Each patch is aligned with the rollstock (906) and a patch is applied (908) to the material. The patch can be applied by adhesion or by heat sealing depending on the packing requirements. The rollstock is then utilized to form a package (910) with the patch being placed on the interior of the package. Alternatively the adhesive patch vent 100 can be applied to the package after manufacture.

Figure 15:
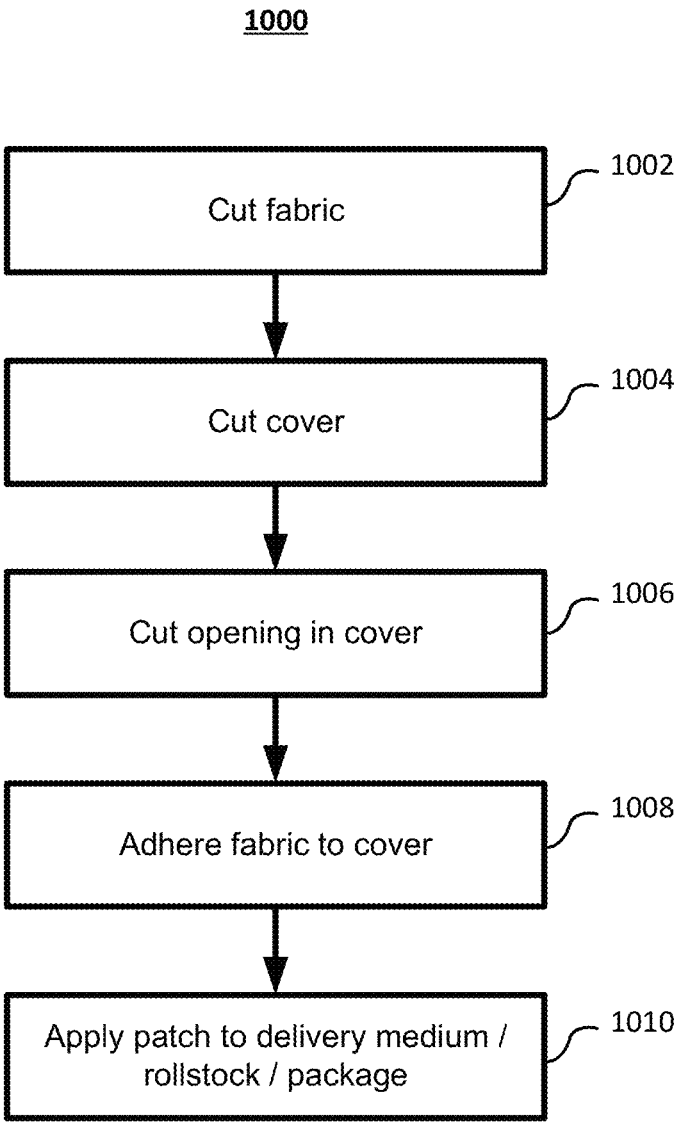
FIG. 15 shows a method of manufacturing a patch vent.

FIG. 15 shows a method 1000 of manufacturing a patch vent. The fabric is cut or formed in to a shape smaller than the desired patch vent (1002). The cover of the patch vent is also cut (1004) and an opening in the vent is formed (1006). The fabric is adhered to the cover (1008) which is then applied to a delivery medium, directly to rollstock or the package (1010). In adhering the fabric to the cover and adhesive layer may be applied to either side of the fabric material.

It would be appreciated by one of ordinary skill in the art that the system and components shown in FIGS. 1-15 may include components not shown in the drawings. For simplicity and clarity of the illustration, elements in the figures are not necessarily to scale, are only schematic and are non-limiting of the elements structures. It will be apparent to persons skilled in the art that a number of variations and modifications can be made without departing from the scope of the invention as defined in the claims.

The invention claimed is:

1. An adhesive patch vent for application to a package formed of a flexible packaging material for containing food products having a high fat content, the adhesive patch vent and package comprising:

a fabric material; and a plastic cover having an opening provided therein;

a first food grade oil resistant adhesive layer between the plastic cover and a first surface of fabric material along outer portions of the fabric material where a central adhesive free portion aligns with the opening of the plastic cover; and a second food grade oil resistant adhesive layer applied to a second surface of the fabric material along outer portions of the fabric material where a central portion is adhesive free wherein the adhesive patch vent is applied to an interior wall of the package formed by the flexible packaging material by the second food grade oil resistant adhesive layer where the central adhesive free portion aligns the adhesive patch vent with a cross-cut perforation in the flexible packaging material and the fabric material is between the plastic cover and the flexible packaging material, the fabric material allowing bi-directional air flow between an interior and an exterior of the package formed by the flexible packaging material.

2. The adhesive patch vent of claim 1 wherein the adhesive patch vent is less than approximately 2 inch square.

3. The adhesive patch vent of claim 1 wherein the adhesive patch vent is less than approximately 1 inch square.

4. The adhesive patch vent of claim 1 wherein the adhesive free portion is less than approximately 0.5 inches in diameter.

5. The adhesive patch vent of claim 1 fabric has openings less than 80 microns.

6. The adhesive patch vent of claim 1 wherein the adhesive patch is applied to packaging material rollstock prior to forming a package from the flexible packaging material.

7. The adhesive patch vent of claim 1 wherein the adhesive patch is applied to a formed package aligned with a perforation in a wall of the formed package.

8. The adhesive patch of claim 1 where in the fabric is made of a polyethylene, polypropylene, polyester, or nylon material.

9. The adhesive patch vent of claim 1 wherein the opening of the one or more perforations open to the exterior of the flexible package material, wherein the adhesive patch vent is provided between an interior of the package and the flexible packaging material.

* * * * *